US008591149B2

(12) United States Patent
Lacroix et al.

(10) Patent No.: US 8,591,149 B2
(45) Date of Patent: Nov. 26, 2013

(54) SECURED FUSEGATE FOR FLOOD CONTROL

(76) Inventors: Sebastien Lacroix, Carrieres sur Seine (FR); Sylvain Chevalier, Paris (FR); Martin LeBlanc, Paris (FR)

( * ) Notice: Subject to any disclaimer, the term of this patent is extended or adjusted under 35 U.S.C. 154(b) by 474 days.

(21) Appl. No.: 12/738,804

(22) PCT Filed: Oct. 17, 2008

(86) PCT No.: PCT/FR2008/001468

§ 371 (c)(1),
(2), (4) Date: May 3, 2011

(87) PCT Pub. No.: WO2009/090340

PCT Pub. Date: Jul. 23, 2009

(65) Prior Publication Data

US 2011/0229268 A1 Sep. 22, 2011

(30) Foreign Application Priority Data

Oct. 19, 2007 (WO) ..... PCT/FR07/01735

(51) Int. Cl.
*E02B 8/06* (2006.01)

(52) U.S. Cl.
USPC ..... 405/108; 405/94; 405/92

(58) Field of Classification Search
USPC ..... 405/87, 88, 89, 90, 92, 93, 94, 99, 100, 405/101, 102, 107, 108
See application file for complete search history.

(56) References Cited

U.S. PATENT DOCUMENTS 5,032,038 A * 7/1991 Lemperiere ..... 405/108
5,061,118 A * 10/1991 Lemperiere ..... 405/108
5,195,846 A * 3/1993 Lemperiere ..... 405/108
5,882,144 A * 3/1999 Lemperiere ..... 405/94
6,196,764 B1 3/2001 Bayssiguier

FOREIGN PATENT DOCUMENTS

| | | |
|---|---|---|
| EP | 0 434 521 | 6/1991 |
| EP | 0 435 732 | 6/1991 |
| EP | 0 493 183 | 7/1992 |
| FR | 2 733 260 | 10/1996 |
| WO | WO 2007/000508 | 1/2007 |
| WO | WO 2009/050342 | 4/2009 |
| WO | WO 2011/131886 | * 10/2011 |

* cited by examiner

*Primary Examiner* — Frederick L Lagman
(74) *Attorney, Agent, or Firm* — Harness, Dickey & Pierce, P.L.C.

(57) ABSTRACT

The disclosure concerns a fusible shutter for a water structure such as a river sill, or a spillway on a dam or on a protective dyke, including a solid element disposed on the top of the structure and held on top by gravity, forming a watertight or substantially watertight wall, installed on the water structure and being able to retract so as to allow water to pass without obstruction when the level of the reservoir or watercourse reaches a predefined level, a chamber being formed at the base of the solid element between the latter and the surface that supports it, pressurization means enabling the chamber to be filled with water in order to create under the solid element a thrust directed upwards when the water in the reservoir or watercourse reaches the predefined level. The disclosure consists in these pressurization means including a water inlet at a feed structure provided with two compartments delimited by an internal vertical wall, the two compartments being in communication with each other through at least one passage provided at the top part of the feed structure, one of the compartments having one or more openings in its bottom part allowing entry of water from the reservoir or watercourse into the feed structure while the other compartment is in communication with the chamber under the solid element. Applications to water structures such as a river sill, or a spillway on a dam or on a protective dyke.

12 Claims, 12 Drawing Sheets

SECURED FUSEGATE FOR FLOOD CONTROL

CROSS-REFERENCE TO RELATED APPLICATIONS

This application is a National Phase Entry of International Application No. PCT/FR2008/001468, filed on Oct. 17, 2008, which claims priority to International Application No. PCT/FR2007/001735, filed on Oct. 19, 2007, both of which are incorporated by reference herein.

BACKGROUND AND SUMMARY

The present invention concerns a fusegate for a water structure such as a river sill or a spillway on a dam or protective dyke, comprising a structure forming a watertight or substantially watertight wall, installed on the said water structure and held on top by gravity, and able to retract so as to allow water to pass without obstruction, the said structure being dimensioned in terms of weight and size so as to be driven away by the water when the latter has reached a predefined level.

Fusegates of this type are well known and are normally installed on the top of a sill disposed across a reservoir with a view to raising the level of water in the reservoir upstream of the said sill. Installed on the sill of a dam they make it possible to raise the retaining level of the dam or to improve the security of the said dam in the face of floods. They can also be installed on the sill of the spillway of a dyke bordering a river and be intended to protect the adjoining regions against floods, the spillway being in this case installed on the dyke at a location chosen so that, in the event of floods, the water pours into a temporary storage reservoir or onto land chosen without danger for other regions adjoining the river.

Fusegates can be of the non-overflowing or of the overflowing type, namely, in the latter case, they can allow a certain quantity of water to pass over their top when the level of water upstream of the shutter is greater than the retaining height hRN of the top and as long as the water level does not exceed a predefined height hMAX. In all cases, fusegates must retract if the level of the water upstream of the shutter reaches a predefined level hMAX during a flood, in order to release the volume of water that it retains in the reservoir and thus to prevent the water invading the adjoining regions upstream or damage to the dyke or dam.

Fusegates apply in particular to a levy or dyke or dam constructed from fill or a mixed dyke or dam constructed partly from fill and partly from concrete or masonry. The dyke can be a frontal dyke across a watercourse, or a lateral dyke along a watercourse for protecting the surrounding land against flood. In the case of a dam, it may be a case of any type of dam creating a water reservoir, or a saddle dam associated with the aforementioned dam.

On many water structures of the type indicated, it is known how to create favoured rupture points which, in the case of exceptional events, such as exceptional floods threatening the structure with destruction, yield at predetermined locations on the structure chosen so that the damage caused to the structure itself and/or to the persons or goods flooded by the rupture of the structure are minimal. These rupture points can be formed with the help of fusegates positioned on the top of the part of the dyke, embankment or dam chosen, or other system allowing discharge of the necessary flow rates. Such a shutter comprises at least one solid rigid shutter element placed on the top of the overflow sill and is maintained in place on the latter by gravity, the said shutter element having a predetermined retaining height hRN and being dimensioned in terms of size and weight so that the moment of the forces applied by the water to the shutter element reaches, for a certain predefined level hMAX, the moment of the gravity forces that tend to hold the shutter element in place on the overflowing sill and so that consequently the said shutter element is unbalanced and driven away when the water level upstream of the shutter reaches a predefined level hMAX.

It is clear that, for floods of moderate magnitude, as long as the level of the water does not reach the predefined level $h_{MAX}$ of unbalancing the shutter, which can be determined in practice so as to be equal to or slightly lower than a level of the highest water, the water can be discharged by the valves and other devices sized for the most usual flow rates, without destruction of the shutter resulting from this and subsequently without the spillway ceasing to be closed off by the said shutter. On the other hand, in the case of an exceptional flood, the level of the water reaches the predefined level $h_{MAX}$ of unbalancing the shutter and one or more of the shutter elements are automatically unbalanced and driven away by the water solely under the action of the forces of the water and therefore without external intervention being necessary, thus giving the sill its full discharge capacity again. So as to promote the unbalancing and tilting of the said shutter element or elements at the time when this becomes essential to discharge an exceptional flood, means are provided for generating a pressure, referred to as underpressure in the terminology accepted by hydraulic engineers, in a chamber formed under the shutter element or elements, when the water level reaches the predefined level $h_{MAX}$ of unbalancing the shutter. Such means can advantageously be arranged so that the underpressure applied in the chamber of the shutter element remains zero or very low as long as the water level remains below the predetermined level $h_{MAX}$, and so that an underpressure with a substantially higher value is abruptly applied to the shutter element at the instant when the water level reaches the said predetermined level, the sizing of the elements being such that, at this instant, the destabilising driving moment becomes greater than the stabilising moment. Such means are formed in particular by a conduit referred to as a well having a bottom end opening out in the said chamber and a top end situated at a level corresponding to the said predefined level.

The systems of the prior art are confronted with the problems of vandalism and attacks by external natural phenomena (floating bodies, waves) resulting in reducing their efficacy or precision. In order to resolve this problem, it is known how to equip the top end of the conduit communicating with a chamber with a device protecting against floating bodies in order to avoid blockage thereof, or with a device for protection against waves so that one or more successive waves do not trigger the tilting of the shutter in an unwanted fashion, by creating a pressure in the chamber whereas the predefined level $h_{MAX}$ is not reached. Thus these devices aim to limit the entry of water into the well when one or more successive waves present themselves and thus the level of water close to the water inlet is situated above the level of the well whereas the average water height in the reservoir or of the watercourse does not reach the predefined tilting level $h_{MAX}$. Such a device can consist of a funnel, the top edge of which is situated at a higher level than the predefined level as described in the patent applications FR 2 733 260 or EP 0 493 183.

In other spillway devices for discharging floods such as those described in EP 0 435 732, other forms are proposed for this protection device in which the end of the conduit is curved in the form of a siphon or consists of a protective barrel that covers the top end of the pipe and the top of which is situated at a level slightly higher than the predetermined level $h_{MAX}$. However, it has been possible to remark that such protection devices are not always sufficient. Thus the funnel form, though it offers protection against floating debris, does not offer sufficiently effective protection against waves of a certain magnitude. Because of this, the risk is always incurred of a partial tilting relating to waves rather than to an actual flood.

It has also been noted that the bell shape covering the top end of the conduit does not offer sufficient guarantees vis-à-vis risks of obstruction by floating debris, nor by waves. This is because, for this embodiment, in normal operation, that is to say when the water level is below or equal to the retaining height hRN of the shutter, the water inlet opening of the bell is situated above the water level, so that floating debris may obstruct the water inlet or the well itself and in addition the well remains accessible to any vandals. In addition, having regard to the position of the water inlet opening, the well remains sensitive to waves so that risks of undesired tilting are still incurred. Consequently, the fusegates described above remain subject to the following causes of degraded operation: vandalism, in particular the theft of metal parts, effects relating to high-magnitude waves that may trigger the tilting of the shutter whereas the level is not actually reached, and the blocking of the pressurisation means by debris floating on the surface of the water.

Moreover, the adjustment of the predefined tilting height of the shutters is not very precise. This is because, in some cases, when the water level in the reservoir or watercourse is appreciably greater than the retaining height hRN of the shutter, the water level tends to decrease, by a height Δh, on approaching the shutter, because of the increase in the speed of flow of the water in the channel 14 connecting the water retention to the overflow sill. Thus it is difficult to precisely determine the predefined water level in the reservoir or watercourse for which a shutter would be unbalanced, in particular because of the low sensitivity of the height of water close to the shutter to the variations in general level of the watercourse or reservoir.

The main aim of the invention that is the subject matter of the present application is to propose a shutter overcoming the problems of the prior art mentioned above, where sensitivity to the problems of vandalism and attacks by external natural phenomena is less and the operation of which is optimised, and allowing in particular finer regulation of the tilting height of the shutters. For this purpose, the subject matter of the invention is a fusegate for a water structure comprising:

- a solid element comprising a wall with a retaining height hRN;
- a chamber formed at the base of the solid element between the solid element and a support surface for the solid element; and
- means of pressurising the chamber, enabling the chamber to be filled with water in order to create under the solid element a thrust directed upwards, so as to allow the retraction of the solid element by tilting when the water upstream of the shutter reaches a predefined level hMAX;

the shutter being remarkable in that the pressurisation means comprise a structure feeding the chamber provided with two compartments delimited by an internal wall, the two compartments communicating with each other through a passage formed at the top part of the feed structure at a height corresponding substantially to the predefined water level hMAX for the tilting of the shutter, one of the compartments having at least one water inlet opening in the feed structure, disposed at a height h less than the retaining height hRN, and the other compartment communicating with the chamber.

Thus, the water inlet, that is to say the water inlet opening in the structure, is situated below the top of the shutter. In other words, the fusegate, for a water structure such as a river sill, a spillway on a dam or on a protective dyke, comprises a solid element disposed on the top of the structure and held on top by gravity forming a watertight or substantially watertight wall, installed on the water structure and being able to be retracted so as to allow water to pass without obstruction when the level of the reservoir or watercourse reaches a predefined level, a chamber being formed at the base of the solid element between the latter and the surface that supports it, pressurisation means allowing the filling of the chamber with water to create under the solid element a thrust directed upwards when the water in the reservoir or watercourse reaches the predefined level, characterised in that these pressurisation means consist of a water inlet at a feed structure provided with two compartments delimited by an internal vertical wall, the two compartments being in communication with each other through at least one passage formed at the top part of the water inlet, one of the compartments having one or more openings in its bottom part allowing the entry of water from the reservoir or watercourse into the water inlet while the other compartment communicates with the chamber under the solid element.

Consequently, when the water rises, the water inlet opening in the feed structure is submerged. Thus, highly advantageously, in the case of a rise in the water, the water enters the pressurisation means in a regular fashion from an immersed opening, at the bottom part of the feed structure, so that in this way all the risks of obstruction of the entry of the pressurisation means by debris floating on the surface of the water are avoided since they are situated below the surface.

Moreover, the risks of vandalism such as theft of parts on such shutters are also limited since access to the compartment communicating with the chamber is limited. Thus the difficulty of access to the compartment is increased so that the theft of accessories produced from metal, stainless steel for example, is relatively complicated. The inviolability of the device is therefore improved. Consequently, a fusegate according to the present invention comprises means used for combating vandalism and attacks external to the shutter.

In addition, highly advantageously, the consequences of imprecision due to the effect of waves are reduced since, when these occur, they have no effect on the quantity of water entering the feed structure thus formed, since the water inlet opening in the feed structure is immersed under the level of the top of the shutters, preferably below the level of the trough of the waves. The precision associated with the upstream water height causing the tilting of the shutters is thus greatly improved. Preferably, the water inlet opening in the feed structure is disposed at a height h less than $h_{RN}-\frac{1}{2}L$, with L the theoretical maximum wavelength of the waves associated with the water structure. Thus the water inlet opening is situated below the level of the wave troughs, even when the theoretical amplitude of the waves is maximum, so that the influence of the waves on the tilting of the shutter is completely eliminated.

Advantageously, the water inlet opening in the feed structure is disposed close to the bottom portion of the chamber feed structure. Thus the water inlet opening is necessarily situated below the wave trough. According to a preferred embodiment, the water inlet and therefore the feed structure are located on the base of the solid element, above the pressurisation chamber, substantially in the form of a hollow column.

According to another embodiment, the water inlet and the feed structure are provided outside the solid element. The passage between the two compartments of the feed structure is provided between the top part of the feed structure and the top end of the internal vertical wall. According to a first variant embodiment, the feed structure according to the invention comprises a so-called upstream compartment comprising at its base a water inlet facing upstream that thus makes it possible to recover part of the kinetic energy of the current. In other words, the water inlet opening in the feed structure is disposed on the upstream face.

By virtue of the feed structure described above, it is possible to achieve a finer regulation of the water height causing the tilting of the shutters. This is because, first, it was necessary to position the level of the wells of the shutters at staged heights, the separation of which was great so as to compensate for the imprecision in the tilting heights of the adjacent shutters, due in particular to the phenomenon of decrease of the water level approaching the shutter, illustrated in FIG. 9. In particular, it was necessary to stage the tilting levels of several shutters by a height corresponding to the nominal filling required to cause the pressurisation of the shutter, in order to obtain tilting of the shutters in the required order and to prevent simultaneous tilting.

The described feed structure method makes it possible to reduce the nominal filling water height and advantageously makes it possible to reduce the difference in tilting height between the shutters. A finer regulation of the water level in the reservoir upstream is obtained during flood episodes. It is also possible to delay the tilting of the first shutter since the separation in tilting level between the feed structures is reduced.

Moreover, in certain configurations illustrated in FIG. 9, when an adjacent shutter tilts, the water level on the spillway drops because of the increase in the rates of flow over the sill and it is then difficult to produce a well that makes it possible to put the bottom chamber under pressure for higher water levels in the reservoir. A suitable configuration of the shutter feed structure according to the invention with an admission of water on the front face makes it possible to generate a pressure (H) resulting from the static pressure corresponding to the water level on the spillway ($h_e$) and the kinetic pressure corresponding to the rate of flow of water over the spillway ($v^2/2g$). The resulting pressure (H) corresponds to the general water level in the reservoir or in the watercourse ($H=h_e+v^2/2g$).

According to a second variant embodiment the water inlet can be provided on a lateral face of the upstream compartment of the feed structure so that the water intake is independent of the rate of flow. In other words, the immersed water inlet opening in the feed structure is disposed on a lateral face so that the entry of water is independent of the speed of the current. Thus, as seen, the water enters through the bottom of the first compartment and rises in the feed structure as far as the top end of the internal vertical wall and then, once a predetermined level is reached, flows into the second compartment and therefore to the chamber under the solid element. Preferably, the top end of the internal vertical wall is provided with a labyrinth for increasing the water passage flow rate.

The fusegate according to the invention may or may not have a rectilinear top. In one embodiment of the invention, part of the shutter referred to as a beam has bevelled edges and, on the upstream part of the bottom face of the beam, a band is provided that is in abutment on a secondary fixing cast in a groove provided on a pedestal. According to one embodiment, the internal wall of the feed structure defines two compartments, the compartment in which the water enters through an immersed opening surrounding the compartment communicating with the chamber.

BRIEF DESCRIPTION OF THE DRAWINGS

The invention will now be described in more detail with reference to the drawing, in which.

DETAILED DESCRIPTION

The fusegate according to the invention is intended to be positioned on the top of a water structure such as a river sill, or a spillway on a dam or on a protective dyke. It consists of a solid element 1 held on the top by gravity and forming a watertight or substantially watertight wall. For this purpose, the solid element 1 comprises at least one wall 13 having a water retaining height hRN.

Figure 1:
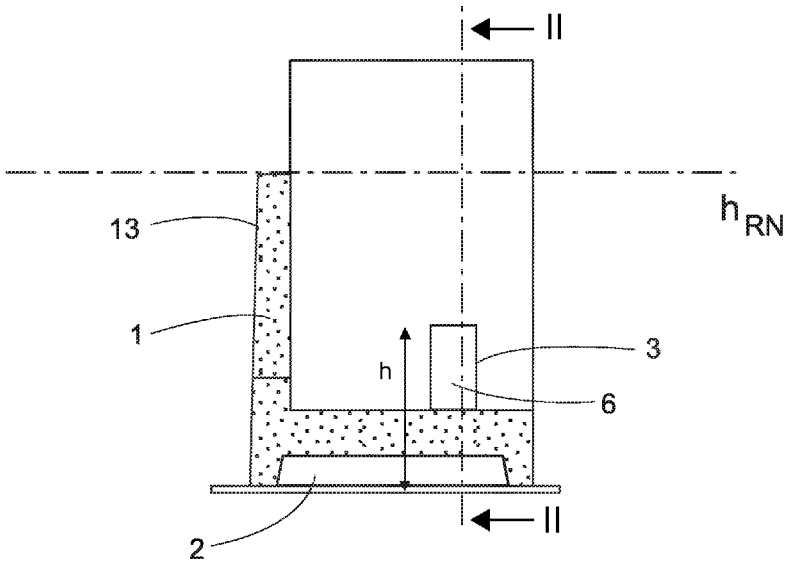
FIG. 1 shows a view in transverse section of a fusegate according to the invention.
Figure 2:
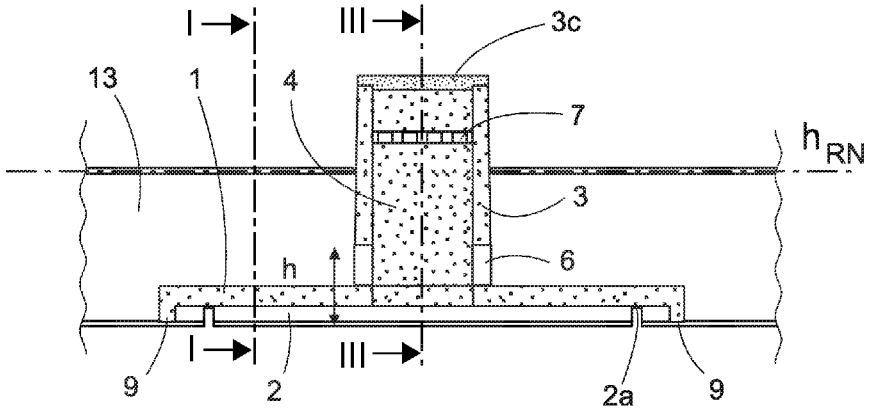
FIG. 2 shows a view in section along the line II-II of the shutter according to FIG. 1.
Figure 3:
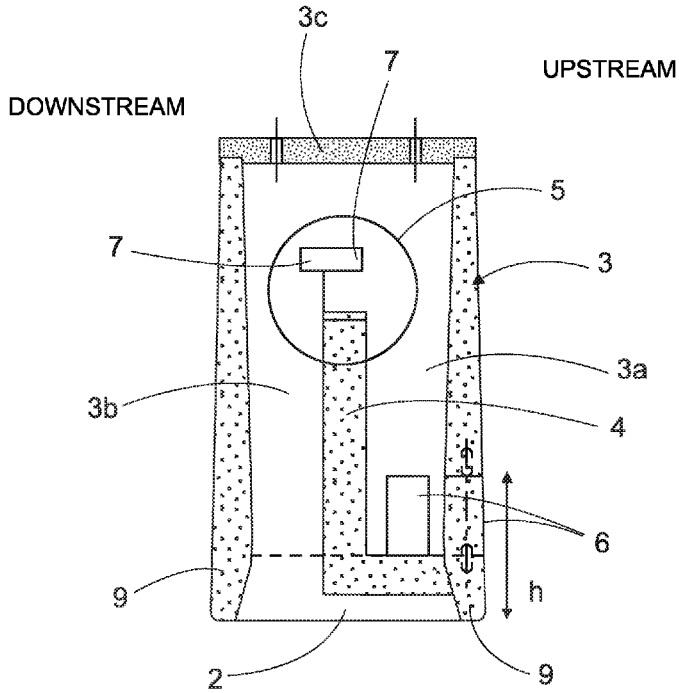
FIG. 3 shows a view in section along the line III-III of the shutter in FIG. 2.

In some cases, the top is not rectilinear and is in the form of a labyrinth for increasing the throughput of the shutter. In other words such an embodiment enables the shutter to make a greater overflow pass for a larger stretch of water. This solid element 1 is installed on the water structure so as to be able to pass from a first upright position as in FIG. 1 and then retract in order to allow the water to pass practically without obstruction when the level of the reservoir or watercourse reaches a predefined level.

A chamber 2 is formed at the base of the solid element 1 between the latter and the surface that supports it. Pressurisation means allow the filling of the chamber 2 with water in order to create under the solid element 1 a thrust directed upwards when the water in the reservoir or watercourse reaches the predefined level $h_{MAX}$. The chamber 2 is also provided with a drain 2*a* for draining water entering the chamber when the shutter is not in nominal tilting configurations. In practice, several shutters are disposed so as to be adjacent and each shutter has a different predefined tilting level $h_{MAX}$ so as to progressively increase the discharge capacity according to the magnitude of the flood. Thus the determination of the tilting height of the shutters must be regulated very precisely so as to obtain tilting of the shutters in the required order and prevent simultaneous tilting of the shutters.

The pressurisation means consist of a feed structure 3 that is provided with two compartments 3*a* and 3*b* delimited by an internal vertical wall 4. These two compartments 3*a* and 3*b* are in communication with each other through a passage 5 provided between the top part of the feed structure 3 and the top end of the internal vertical wall 4. The feed structure 3 preferably has a substantially square cross section open at the top part. In addition, the feed structure is closed by means of a plate 3*c*, which makes it possible to preserve access to the inside of the feed structure 3 in particular for maintenance operations. One of the compartments 3*a* has one or more openings 6 in its bottom part allowing entry of water from the reservoir or watercourse into the feed structure 3 while the other compartment 3*b* is in communication with the chamber 2 at the base of the solid element 1.

The water inlet opening or openings 6 in the feed structure are disposed at a height h less than the retaining height $h_{RN}$. In other words, the top edge of the water inlet opening 6 is situated below the retaining height $h_{RN}$, that is to say below the top edge of the wall 13. Thus the water inlet opening 6 is situated below the access passage of compartment 3*b* communicating with the chamber 2. Thus access of water to the chamber 2 is effected in the form of a chicane. Preferably it was found that the water inlet opening in the feed structure had to be disposed at a height h of less than $h_{RN}-\frac{1}{2}L$, with L the wavelength of the theoretical maximum waves associated with the water structure.

For example, for a given water structure, it is possible to determine, according in particular to data relating to the duration of exposure to winds, the wind force and the dimensions of the reservoir or watercourse, the maximum height of a wave to be considered and its period. It is possible in particular to take as an example a wave with a height of 2 m whose period is 5 seconds. The wavelength of this wave is 20 m. Under these circumstances, it has been found that, at a depth of L/2, that is to say 10 m, this surface swell will not be felt. Consequently, according to the invention, the entry opening 6 of the feed structure is disposed at least 10 m below the water retaining height $h_{RN}$. Preferably the inlet opening 6 is disposed close to the bottom end of the feed compartment.

Figure 8A:
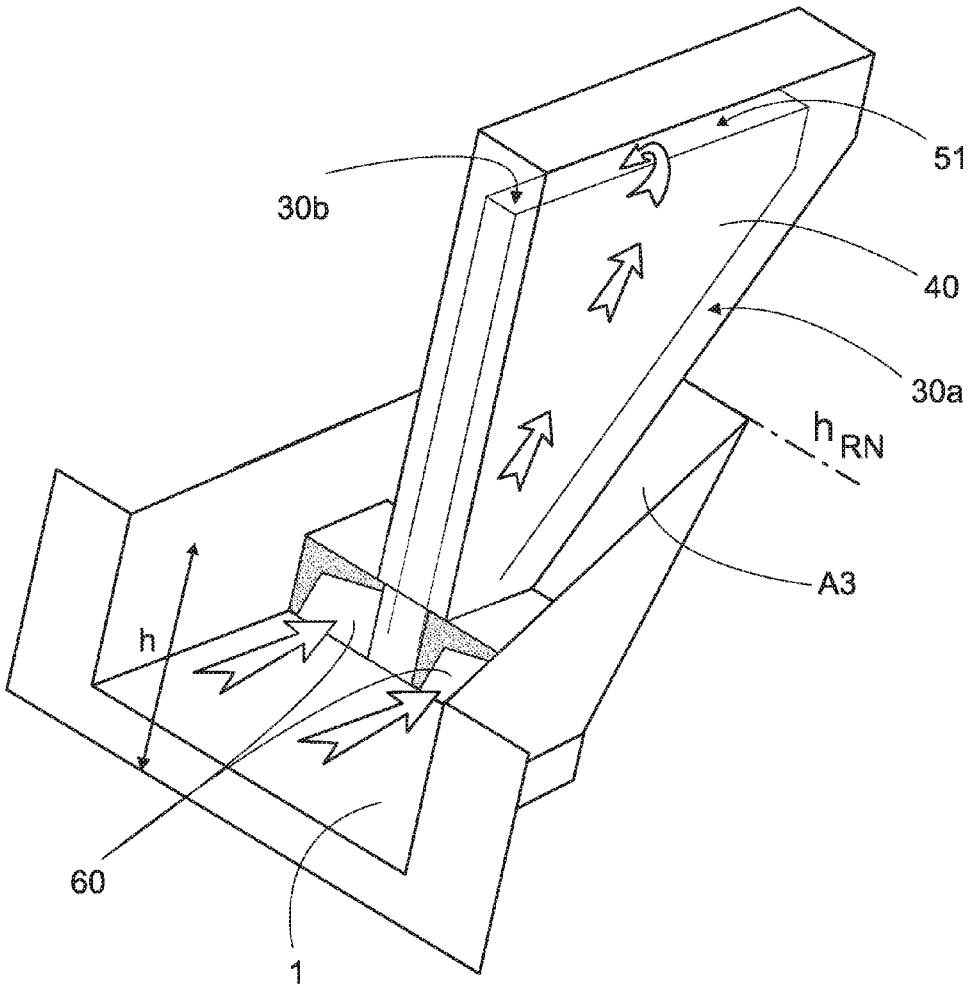
FIGS. 8*a* and 8*b* show respectively views in front perspective of two examples of a fusegate according to the invention having a non-rectilinear top.
Figure 10:
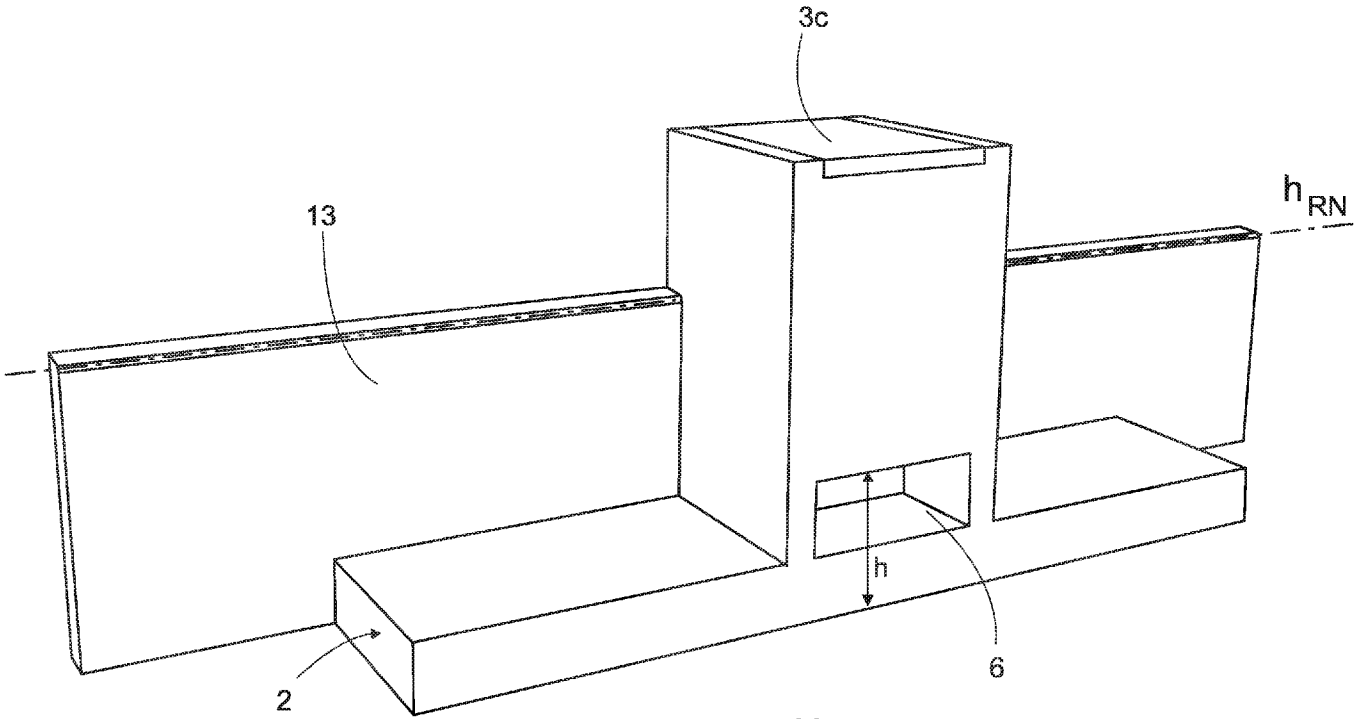
FIG. 10 is a view in perspective of a shutter according to one embodiment, in which the upstream face has a water inlet opening in the feed structure.
Figure 11:
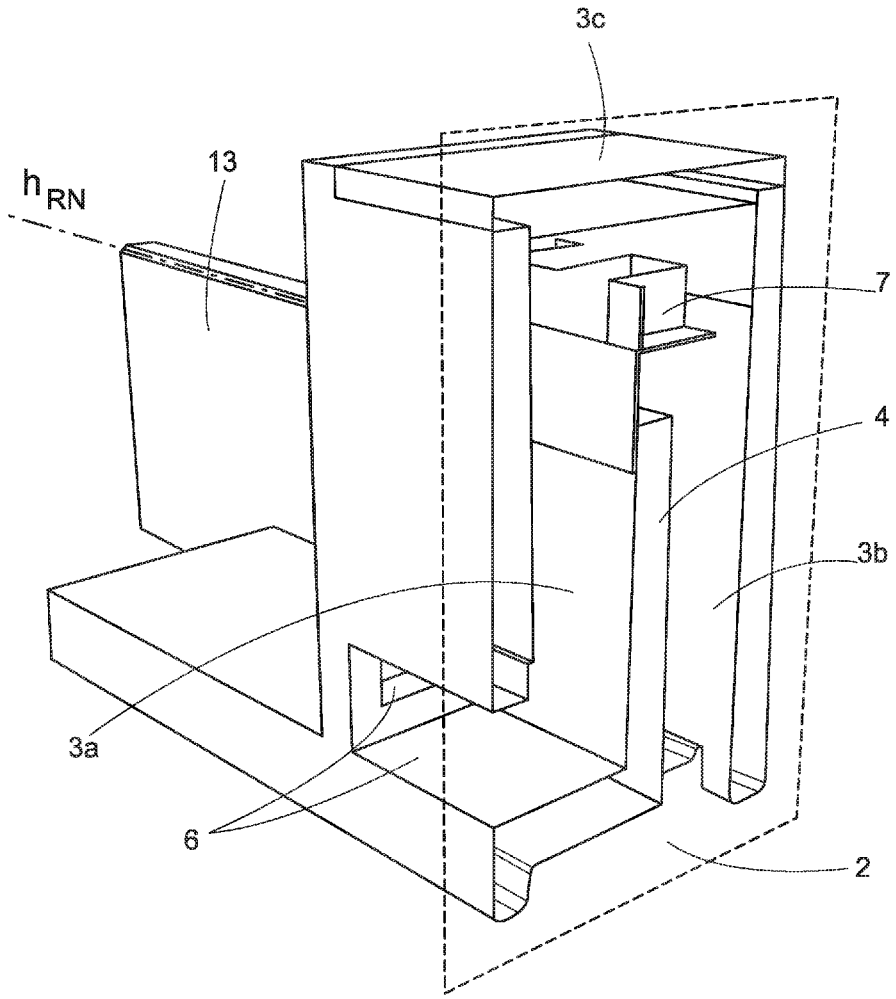
FIG. 11 is a perspective view in section of the shutter in FIG. 2.

In another embodiment that is not shown, it is also possible to provide for the water inlet opening in the feed structure to be situated at a level lower than that of the base of the shutters, that is to say lower than the shutter support surface. This embodiment can in particular be implemented by producing a water intake independent of the shutter described in the remainder of the present document. Moreover it should be noted that, in the embodiments illustrated in FIGS. 1, 2, 3, 6, 7*a* and 7*b*, the feed structure 3 comprises a water inlet opening 6 in the feed structure 3 disposed on the upstream face and water inlet openings disposed on the lateral faces. In other embodiments, shown in FIGS. 8*a*, 8*b* and 10, it will alternatively be possible to provide only one or more inlet openings on the upstream face in order thus to allow recovery of part of the kinetic energy of the current.

In this embodiment, it will be noted that the water level $h_{struct}$ in the feed structure is higher than the level of flow, close to this, because of the recovery of part of the kinetic energy. Thus part of the kinetic energy is recovered so that the water level $h_{struct}$ in the feed structure is independent of the phenomenon of slumping of the water level approaching the shutter and of the speed of the flow of the water in the channel 14.

Figure 12:
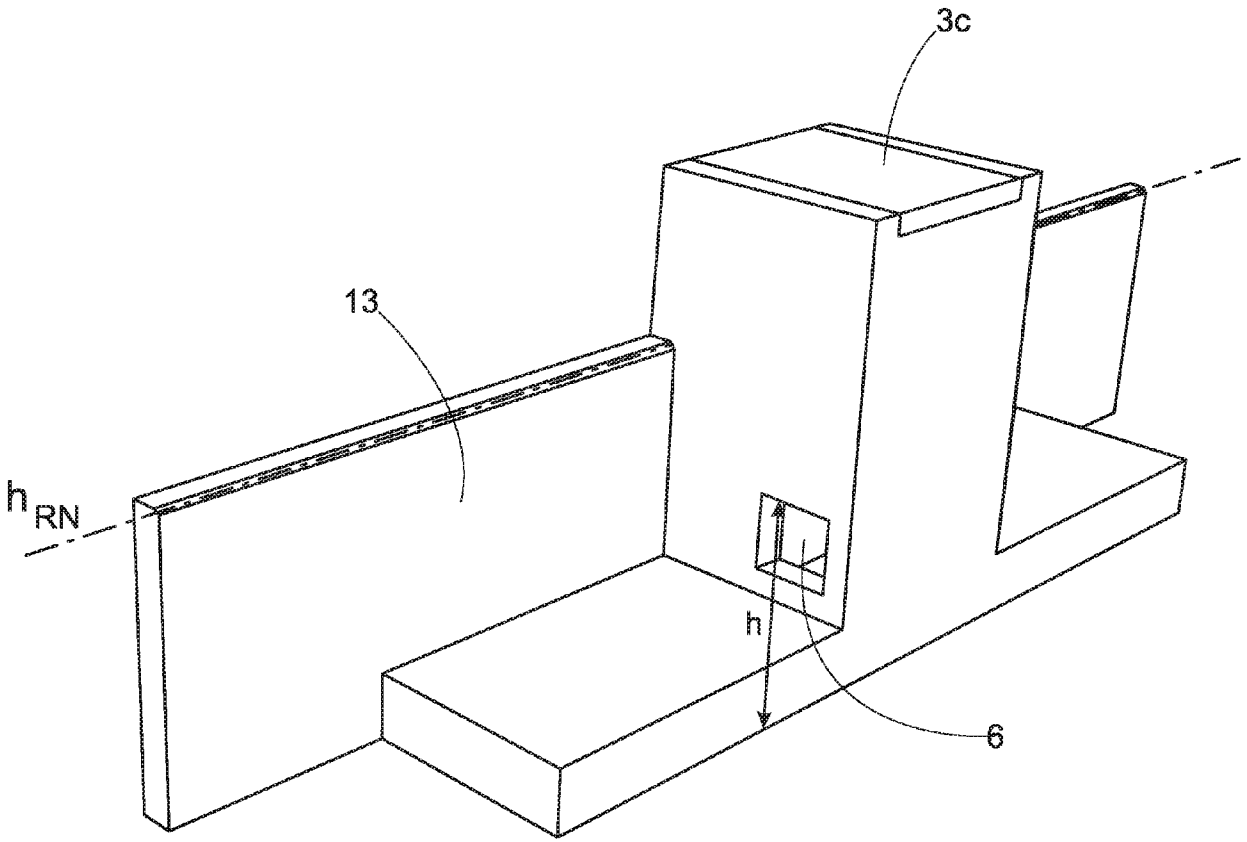
FIG. 12 is a view in perspective of a shutter according to another embodiment, in which the lateral faces have a water inlet opening in the feed structure.

In another embodiment shown in FIG. 12, the device has one or more water inlet openings, disposed only on the lateral face, so that the water entry is independent of the kinetic energy of the current. Consequently, in this embodiment, the tilting of the shutter does not take into account the slump in the water level approaching the shutter and therefore depends on the speed of flow of the water in the channel. This water inlet 6, in the feed structure thus formed, therefore allows a regular flow of water into the feed structure and the phenomenon of waves can no longer create a risk of overpressure in the chamber 2.

Figure 4:
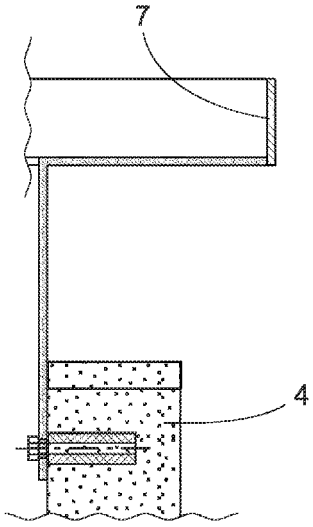
FIG. 4 shows a view in section of the end of the vertical internal wall of the well of the shutter according to the invention.
Figure 5A:
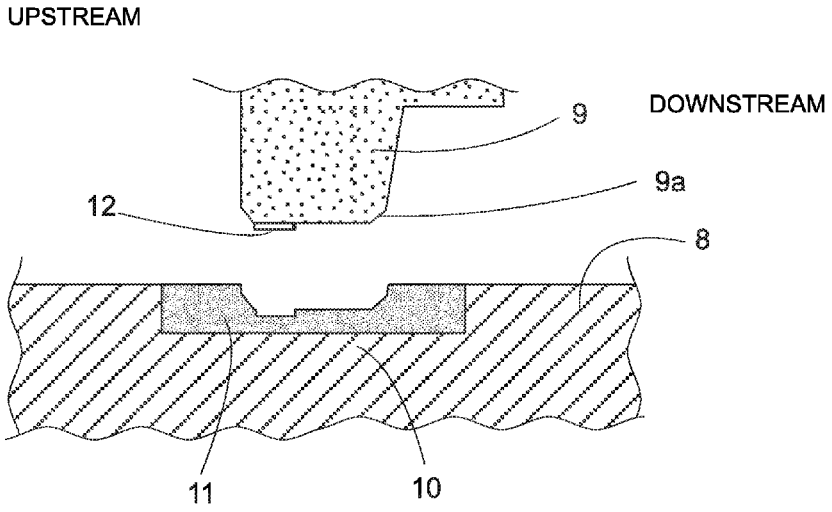
FIGS. 5*a* and 5*b* show a solution proposed for the installation of the base of a shutter in the case where the linearity of the surface of the pedestal cannot be provided with sufficient fine tolerances.
Figure 5B:
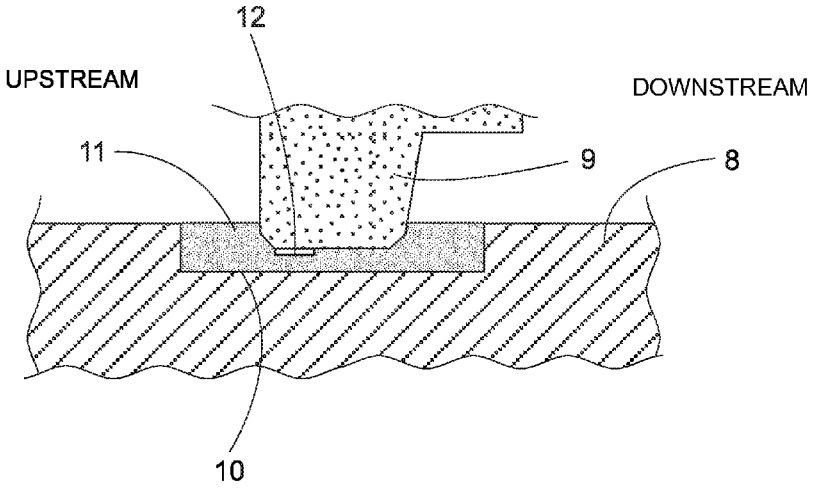
Figure 6:
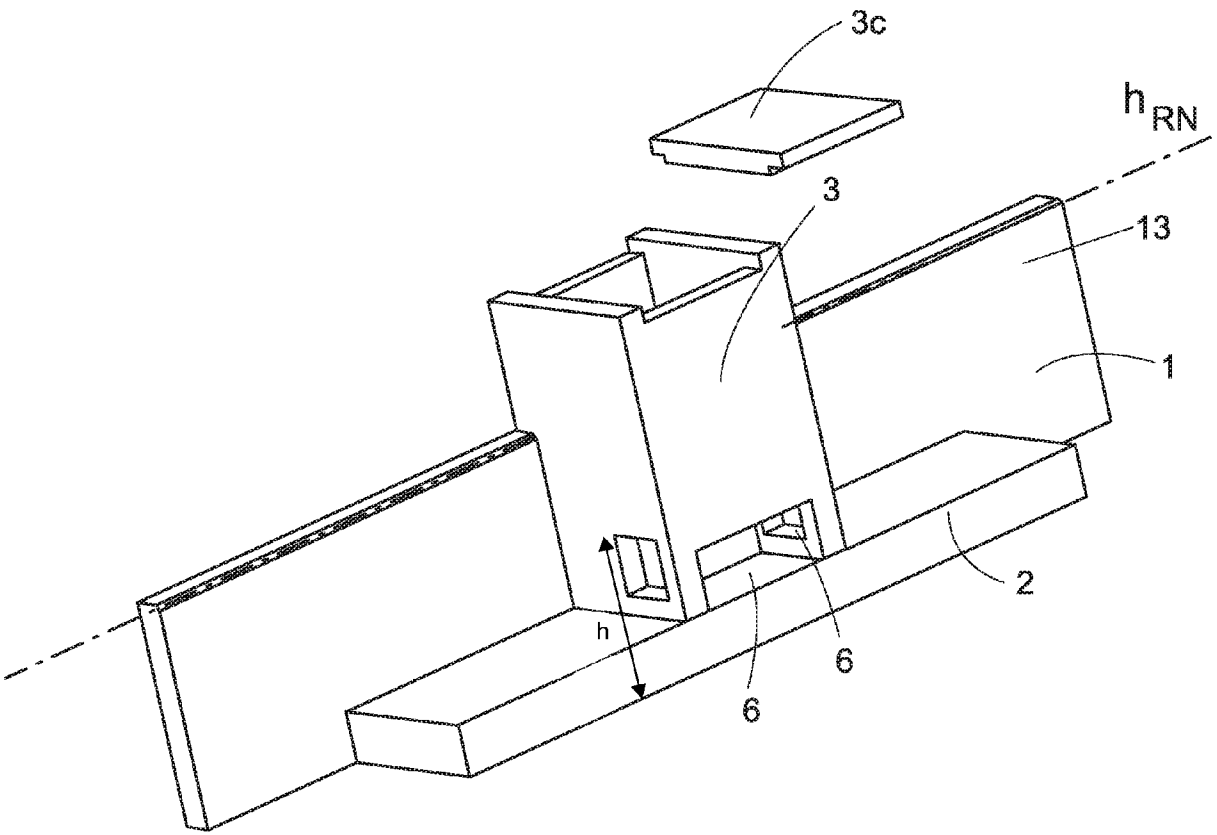
FIG. 6 shows a view in perspective of the top according to FIG. 2.
Figure 7A:
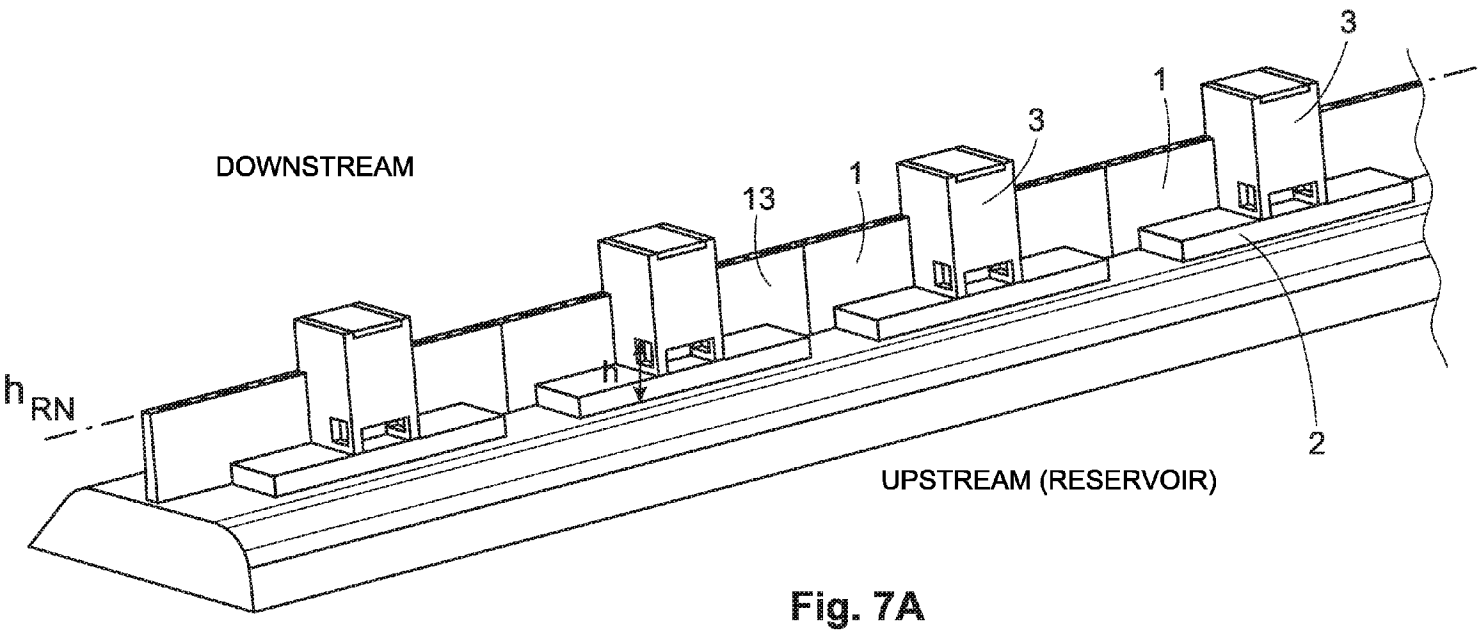
FIGS. 7*a* and 7*b* shown respectively views in front and rear perspective of a fusegate according to the invention with a rectilinear top.
Figure 7B:
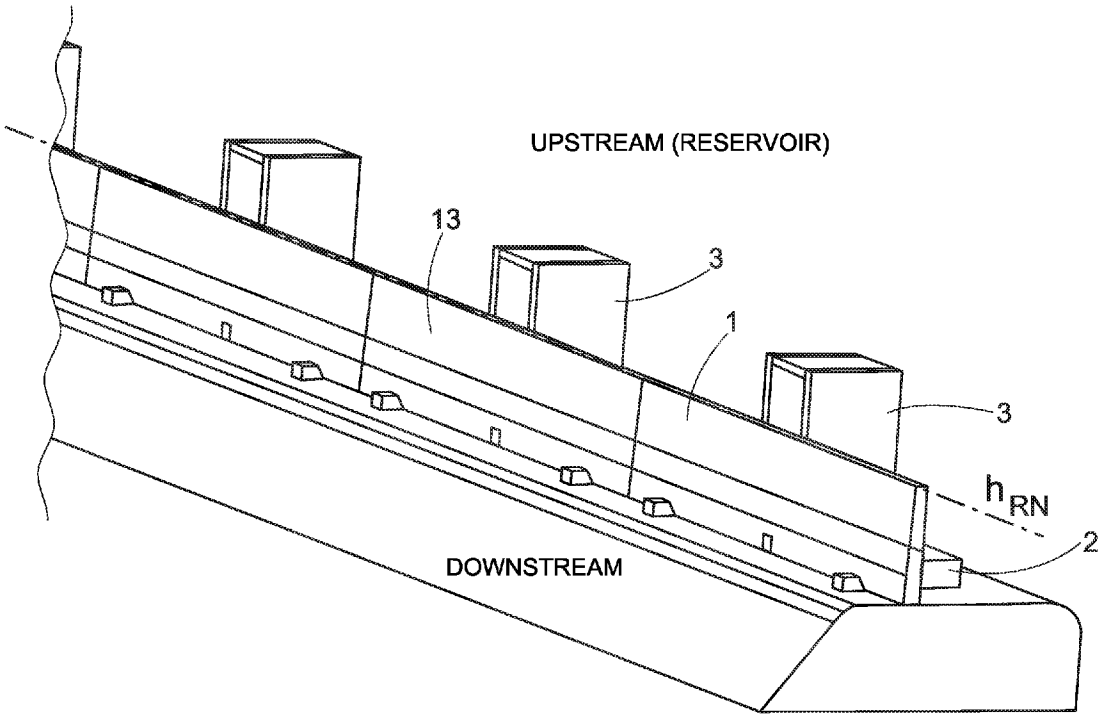

Preferably, at the end of the vertical internal wall 4, a labyrinth 7 is put in place, thus making it possible to increase the flow of water in the feed structure towards the chamber 2, as can be seen in FIG. 4. This labyrinth 7 can consist of several waves.

Still for the purposes of protection against vandalism and to improve performance, it is also proposed to put in place a seal of a new type at the base of the shutter. This is because, when the shutter rests on its pedestal 8, namely the top of the water structure, it is necessary to provide a certain degree of sealing. To do this, a seal is fitted between the pedestal and the shutter, or more precisely under the part of the shutter called the beam 9. For this purpose, a groove 10 is provided on the pedestal 8, that is to say on the shutter support, in which a secondary sealant is put, such as a self-smoothing grout 11 that makes it possible to obtain an excellent fixing of the shutter and to reduce the space between the shutter 1 and its support 10 to a value close to 0. Bevelled edges 9*a* are produced on the beam 9, and then, on the upstream part of the bottom face of the beam 9, a flexible band 12 is fitted which, in compression between the secondary sealant 11 and the beam 9, provides a sufficient seal.

A shutter according to the present invention therefore has improved qualities from the point of view of both reliability and security against vandalism. In the fusegate with protected single-wave labyrinth according to FIG. 8*a*, the internal wall 40 of the feed structure defines two compartments 30*a* and 30*b*, the compartment 30*a* in which the water enters through the inlet 60 surrounding the compartment 30*b* into which the water falls over the wall 40 through the passage 50, towards the pressurisation chamber.

Figure 8B:
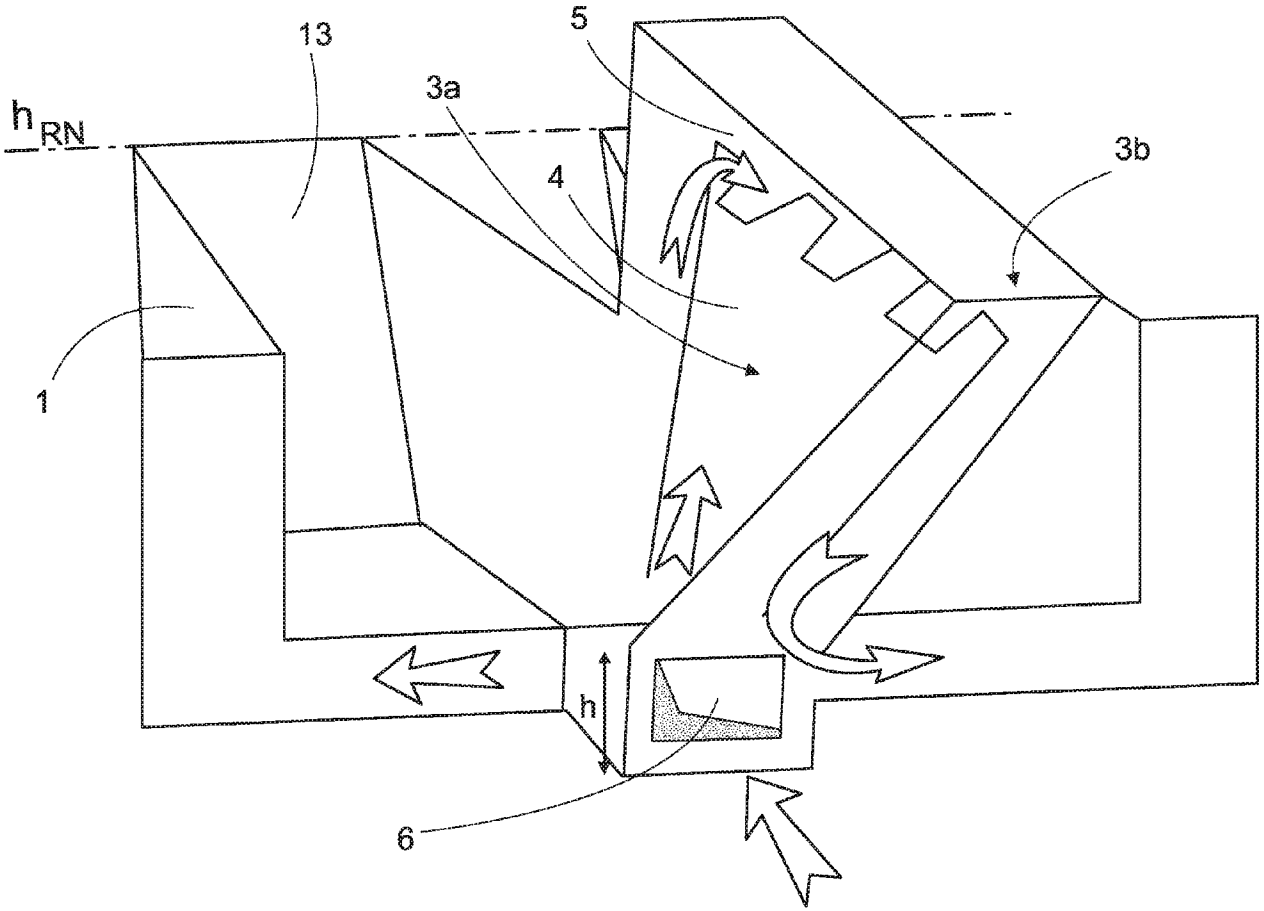
Figure 9:
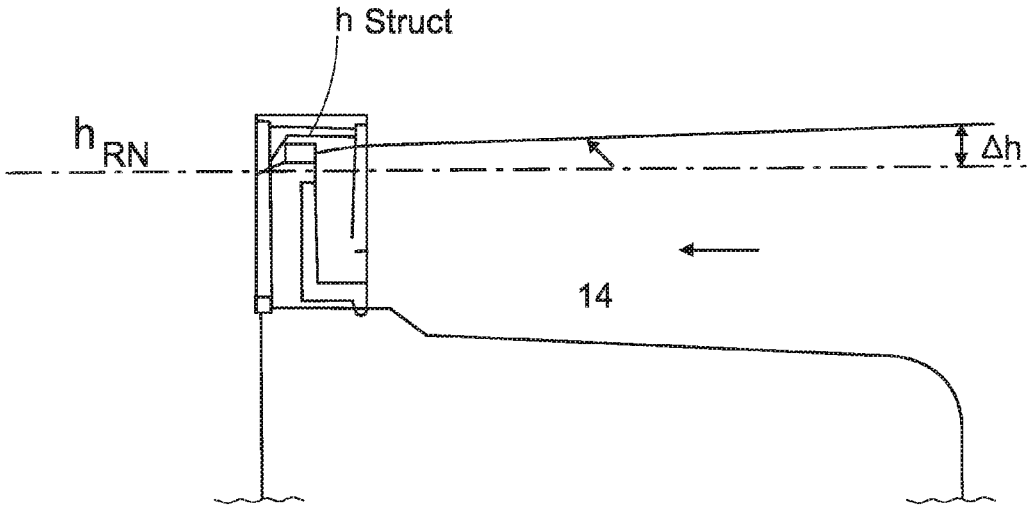
FIG. 9 shows a shutter and the variations in the water level approaching the shutter, because of the increase in the speeds of flow in the channel.

FIG. 8*b* shows another embodiment of a fusegate with protected double-wave labyrinth in which the wall 4 defines two compartments 3*a* and 3*b*. The invention is not limited to the example described but also encompasses the variants of the dependant claims.

The invention claimed is:

1. A fusegate for a water structure, comprising:

a solid element comprising a wall with a retaining height $h_{RN}$;

a chamber formed at the base of the solid element between the solid element and a support surface for the solid element; and a feeder operably pressurising the chamber, enabling the chamber to be filled with water to create under the solid element a thrust directed upwards, so as to allow the tilting of the solid element by tilting when the water reaches a predefined level $h_{MAX}$ upstream of the fusegate;

the feeder further comprising an intake port for the chamber, the intake port being provided with two compartments delimited by an internal wall, the two compartments communicating with each other through at least one passage provided at the top part of the intake port at a height corresponding substantially to the predefined water level $h_{MAX}$ for tilting of the fusegate, one of the compartments having at least one opening for entry of water into intake port, disposed at a height h less than the retaining height $h_{RN}$, and the other compartment communicating with the chamber.

2. A fusegate according to claim 1, wherein the opening for entry of water into the intake port is disposed below the support surface for the solid element.

3. A fusegate according to claim 1, wherein the opening for entry of water into the intake port is disposed close to the bottom portion of the intake port for the chamber.

4. A fusegate according to claim 1, wherein the intake port extends, substantially in the form of a column, from the base of the solid element, above the chamber.

5. A fusegate according to claim 1, wherein the intake port is provided outside the solid element.

6. A fusegate according to claim 1, wherein the passage between the two compartments of the intake port is provided between a top part of the intake port and a top part of the internal wall.

7. A fusegate according to claim 1, wherein the opening for entry of water into the intake port is disposed on the upstream face in order thus to allow the recovery of part of the kinetic energy of the current.

8. A fusegate according to claim 1, wherein the opening for the entry of water into the intake port is disposed on a lateral face so that the entry of water is independent of the kinetic energy of the current.

9. A fusegate according to claim 1, wherein the top end of the internal wall is provided with a labyrinth to increase the water passage flow rate.

10. A fusegate according to claim 1, wherein a part of the fusegate referred to as the beam has bevelled edges and, on the upstream part of the bottom face of the beam, a band is provided that is in abutment on a secondary sealant poured in a groove provided on a pedestal.

11. A fusegate according to claim 1, wherein the internal wall of the intake port defines two compartments, the compartment in which the water enters through the opening for entry of water into the intake port surrounding the compartment communicating with the chamber.

12. A water structure comprising a fusegate according to claim 1, wherein the opening for entry of water into the intake port is disposed at a height h less than $h_{RN}-\frac{1}{2}L$ with L the theoretical maximum wavelength of the waves associated with the hydraulic structure.

* * * * *